US008870308B2

(12) United States Patent
Freimuth

(10) Patent No.: US 8,870,308 B2
(45) Date of Patent: Oct. 28, 2014

(54) UNIVERSAL SAFETY LOCK SYSTEM FOR TOOL CABINETS

(71) Applicant: Versatility Tool Works & Manufacturing Company, Alsip, IL (US)

(72) Inventor: Edward Karl Freimuth, Palos Heights, IL (US)

( * ) Notice: Subject to any disclaimer, the term of this patent is extended or adjusted under 35 U.S.C. 154(b) by 0 days.

(21) Appl. No.: 14/075,591

(22) Filed: Nov. 8, 2013

(65) Prior Publication Data

US 2014/0167575 A1 Jun. 19, 2014

Related U.S. Application Data

(63) Continuation-in-part of application No. 12/272,491, filed on Nov. 17, 2008, now Pat. No. 8,696,074.

(51) Int. Cl.
*E05B 65/46* (2006.01)

(52) U.S. Cl.
CPC ..... *E05B 65/462* (2013.01); *E05B 65/464* (2013.01)
USPC ..... 312/218

(58) Field of Classification Search
CPC ..... E05B 65/44; E05B 65/46; E05B 65/464; E05B 65/463; A47B 2097/008; A47B 2210/0089
USPC ..... 312/215–222
See application file for complete search history.

(56) References Cited

U.S. PATENT DOCUMENTS

| | | | | | |
|---|---|---|---|---|---|
| 3,360,318 | A * | 12/1967 | Studinski | ..... | 312/217 |
| 3,589,783 | A * | 6/1971 | Studinski et al. | ..... | 312/127 |
| 3,969,008 | A * | 7/1976 | Pergler | ..... | 312/221 |
| 4,272,138 | A * | 6/1981 | Stark | ..... | 312/221 |
| 4,447,098 | A * | 5/1984 | Parker | ..... | 312/216 |
| 4,637,667 | A * | 1/1987 | Reid et al. | ..... | 312/217 |
| 4,768,844 | A * | 9/1988 | Ludwig | ..... | 312/221 |
| 4,865,404 | A * | 9/1989 | Harper | ..... | 312/221 |
| 5,184,887 | A * | 2/1993 | O'Keefe et al. | ..... | 312/221 |
| 5,411,327 | A * | 5/1995 | Norton | ..... | 312/221 |
| 5,599,077 | A * | 2/1997 | Law et al. | ..... | 312/221 |
| 6,722,749 | B1 * | 4/2004 | Pagac | ..... | 312/221 |
| 7,309,114 | B2 * | 12/2007 | Lin | ..... | 312/221 |
| 2003/0025425 | A1 * | 2/2003 | Cheng | ..... | 312/218 |
| 2010/0123375 | A1 * | 5/2010 | Romaen et al. | ..... | 312/215 |

* cited by examiner

*Primary Examiner* — Janet M Wilkens

(74) *Attorney, Agent, or Firm* — Joseph Golant

(57) ABSTRACT

A tool cabinet apparatus with a safety lock system and a method of manufacturing the cabinet. The cabinet includes a shell or frame, an inner panel with openings for installing drawer slides, a plurality of four different drawer configurations, the drawer configurations including drawers of three inches, five inches, seven inches and eight inches, and a block guide attached to the inner panel for stacking three different configurations of lock blocks. One block configuration includes an upper protrusion, another block configuration includes a lower protrusion and a third block configuration is a spacer with no protrusions. To achieve universality, the two blocks with upper and lower protrusions are paired and between such pairs there are three of the third blocks to accommodate each of the eight inch drawers, two of the third blocks to accommodate each of the seven inch drawers, one third block to accommodate each of the five inch drawers and no third blocks to accommodate each of the three inch drawers. Each lock block has opposed offset grooves of different sizes.

18 Claims, 12 Drawing Sheets

170

| | Total Drawers | 3" Drawers | 5" Drawers | 7" Drawers | 8" Drawers |
|---|---|---|---|---|---|
| 1 | 10 | 9 | 1 | - | - |
| 2 | 9 | 8 | - | - | 1 |
| 3 | 9 | 7 | 1 | 1 | - |
| 4 | 9 | 6 | 3 | - | - |
| 5 | 8 | 6 | - | 1 | 1 |
| 6 | 8 | 5 | 1 | 2 | - |
| 7 | 8 | 5 | 2 | - | 1 |
| 8 | 8 | 4 | 3 | 1 | - |
| 9 | 8 | 3 | 5 | - | - |
| 10 | 7 | 4 | 1 | - | 2 |
| 11 | 7 | 4 | - | 2 | 1 |
| 12 | 7 | 3 | 1 | 3 | - |
| 13 | 7 | 3 | 2 | 1 | 1 |
| 14 | 7 | 2 | 3 | 2 | - |
| 15 | 7 | 2 | 4 | - | 1 |
| 16 | 7 | 1 | 5 | 1 | - |
| 17 | 7 | - | 7 | - | - |
| 18 | 6 | 3 | - | - | 3 |
| 19 | 6 | 2 | 1 | 1 | 2 |
| 20 | 6 | 2 | - | 3 | 1 |
| 21 | 6 | 1 | 3 | - | 2 |
| 22 | 6 | 1 | 1 | 4 | - |
| 23 | 6 | 1 | 2 | 2 | 1 |
| 24 | 6 | - | 3 | 3 | - |
| 25 | 6 | - | 4 | 1 | 1 |
| 26 | 5 | 1 | - | 1 | 3 |
| 27 | 5 | - | 1 | 2 | 2 |
| 28 | 5 | - | 2 | - | 3 |
| 29 | 5 | - | - | 4 | 1 |

FIG. 11

172

| | Total Drawers | 3" Drawers | 5" Drawers | 7" Drawers | 8" Drawers |
|---|---|---|---|---|---|
| 1 | 8 | 8 | - | - | - |
| 2 | 7 | 6 | - | 1 | - |
| 3 | 7 | 5 | 2 | - | - |
| 4 | 6 | 4 | 1 | - | 1 |
| 5 | 6 | 4 | - | 2 | - |
| 6 | 6 | 3 | 2 | 1 | - |
| 7 | 6 | 2 | 4 | - | - |
| 8 | 5 | 3 | - | - | 2 |
| 9 | 5 | 2 | - | 3 | - |
| 10 | 5 | 2 | 1 | 1 | 1 |
| 11 | 5 | 1 | 3 | - | 1 |
| 12 | 5 | - | 4 | 1 | - |
| 13 | 5 | 1 | 2 | 2 | - |
| 14 | 4 | 1 | - | 1 | 2 |
| 15 | 4 | - | 2 | - | 2 |
| 16 | 4 | - | 1 | 2 | 1 |
| 17 | 4 | - | - | 4 | - |

FIG. 12

UNIVERSAL SAFETY LOCK SYSTEM FOR TOOL CABINETS

PRIORITY REFERENCE

This application is a continuation-in-part and claims priority pursuant to 35 U.S.C. 119(e) or 120 from U.S. application Ser. No. 12/272,491, filed, Nov. 17, 2008, entitled "Safety Lock System For Cabinet Drawer" now U.S. Pat. No. 8,696,074, which is expressly incorporated herein by reference.

FIELD OF THE INVENTION

The present invention relates generally to a tool cabinet locking system, and, more particularly, to a tool cabinet safety locking system that enables only one drawer to open at a time, the safety locking system being flexible and adjustable to allow different drawer configurations to be combined in "standard" sized cabinet shells.

BACKGROUND OF THE INVENTION

Office file cabinet locking systems are known in the art. For example, a 1997 U.S. Pat. No. 5,599,077, listing Law and Parker as inventors, issued for a "Cabinet Locking System" and purports to disclose a system for preventing more than one drawer of a multi-drawer office file cabinet from opening at the same time and, also, for locking all of the drawers from opening. The system includes a U-shaped guide way formed by the cabinet side panel in which a stack of channel shaped members, called block units, are vertically movable. Each block unit has an aperture in a front surface to receive a locking member. Mounted in front of the stack of block units is an elongated angle element called a locking element that is fastened to the upper most block unit but movable relative to the other lower block units. The locking element has a series of locking slot designed to register with the aperture of each block unit. The locking element also includes elongated slots to accommodate rollers connected to the upper and lower ends of each block unit. The lower roller of an upper block unit is paired with an upper roller of the adjoining lower block unit. Attached to the side of each cabinet drawer is a side rail that engages a pair of rollers when the drawer is opened. This causes the block units and the locking element above the roller that is engaged to move upward. The result is that roller pairs above the engaged roller pair are misaligned with drawer rails of drawers above the opened drawer so as to prevent the non-opened drawers from opening. The misalignment causes drawer rails to abut a roller rather then slide into the nip between rollers. The drawers below the opened drawer cannot open because there is no vertical space available in the guide way to move either the block units or the locking element. When all of the drawers are closed, a locking member may move horizontally and be received by a registered aperture of a block unit and a locking slot of the locking element to preventing vertical movement of both the block units and the locking element.

Another U.S. Pat. No. 5,829,859, issued in 1998 to Cram for a "Bi-Directional Drawer System" and purports to disclose an office file cabinet having one set of drawers that may open from the front of the cabinet and another set that may open from the rear of the cabinet. Like the earlier mentioned '077 patent, a system for allowing only one drawer at a time to open is presented. The system uses a vertical stack of locking bars movable in a channel shaped support. The locking bars are also channel shaped. Each locking bar has rollers called cam followers attached to the bars ends such that pairs of cam followers operate just as in the '077 patent. Each drawer includes a rail, called a cam, with an inclined surface at the cam's leading edge. The locking bars are displaced either by a locking mechanism located above the stacked locking bars, the locking mechanism using a key operated cam, or displacement may come from a cam of an opened drawer. When displacement occurs the cam follower pairs of closed drawers are misaligned with the corresponding drawer cams such that an attempted drawer opening results in the cam abutting a cam follower. A spring beneath the stack of locking bars returns the locking bars to their non-displaced positions when an opened drawer is closed.

The inventions discussed in connection with the described embodiments below address deficiencies of the prior art. The features and advantages of the present inventions will be explained in or become apparent from the following summary and description of the preferred embodiments considered together with the accompanying drawings.

SUMMARY OF THE INVENTION

In accordance with the present invention, an advantageous method and apparatus are provided in the form of a tool cabinet with a safety lock to prevent more than one drawer from opening at the same time. There are a number of advantages to the inventions and these are described in detail below. For a manufacturer of the inventive tool cabinets, the cabinets are of simple construction, easy and quick to assemble, have great flexibility in the number and size of drawers that may be used, and yet require a minimum inventory of parts. At a tool cabinet customer level, the cabinets promote safety, offers the prospect of customizing the cabinet to the customer's requirements, allows the customer to easily rearrange existing cabinets when circumstances change and doing so without a need to disassembly the tool cabinet. More particularly, a couple of standard size cabinet shells or platforms may be efficiently and inexpensively customized with drawers of different sizes to meet customer needs. Nevertheless, the safety feature of allowing only-one-drawer-to-open-at-a-time is maintained. The safety feature ensures that a heavily loaded tool cabinet will not tip over and causing serious injury. The tool cabinets, although adjustable, are simply constructed, structurally robust and relatively inexpensive to manufacture.

Briefly summarized, the invention relates to a safety lock system for a tool cabinet including a tool cabinet having a plurality of drawers, each drawer having a projection, a block guide connected to the tool cabinet, the block guide forming a space for a plurality of lock blocks and having a continuous elongated slot extending substantially the length of the block guide, and a plurality of lock blocks slideably received in the block guide space wherein selected portions of the locking blocks extend through the elongated slot for being selectively engaged by the drawer projection when the drawer is opened.

The invention also relates to a method for assembling a tool cabinet having a safety lock system including the steps of attaching a block guide to an inner panel, the block guide having an elongated slot extending substantially along the height of the block guide, connecting the inner panel and the block guide to a cabinet shell, installing a plurality of drawer slides to the inner panel, each drawer having a projection, stacking a plurality of blocks in the block guide, installing springs and a bracket in the block guide above the plurality of blocks, and installing drawers in the cabinet shell.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

FIG. 11 is a front view of a chart illustrating twenty-nine different drawer configurations that may be installed in a tall tool cabinet shell.

FIG. 12 is a front view of a chart illustrating seventeen different drawer configurations that may be installed in a short tool cabinet shell.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
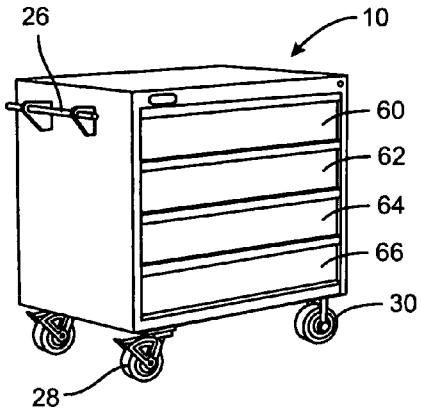
FIG. 1 is an isometric view of a "short" tool cabinet with four drawers of equal size.
Figure 2:
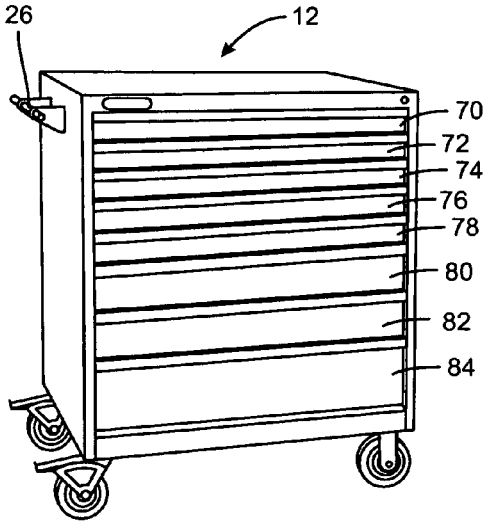
FIG. 2 is an isometric view of a "tall" tool cabinet illustrating eight drawers of three different size configurations.

Referring now to FIGS. 1-6, there is shown two tool cabinets, a "short" cabinet 10, FIG. 1, and a "tall" cabinet 12, FIG. 2. These cabinets may be view as the two "standard" sized cabinets that are dimensioned, with specifically sized drawer configurations, to give the major advantages describe in detail below. Tool cabinets, such as press brake tool cabinets and turret tool cabinets, are used to efficiently store, secure and move heavy tools for forming, bending and cutting metal. Various tools may be placed in a tool cabinet in an organized fashion resulting in several advantages. Namely, each tool may be easily inventoried, tool selection time by a metal former is minimized, tool removal and replacement are efficient, tools are kept clean, and tools are secured from theft.

Figure 5:
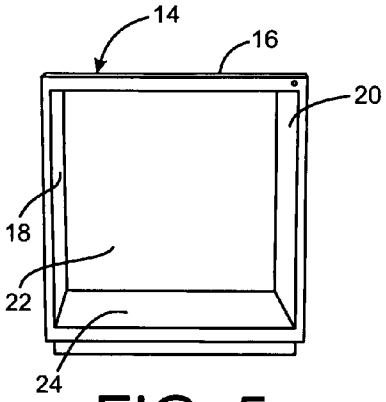
FIG. 5 is a front isometric view of a tall tool cabinet shell without drawers.
Figure 7:
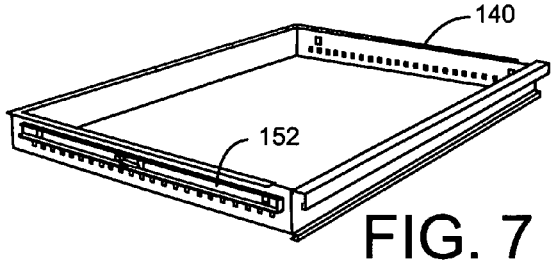
FIG. 7 is an isometric view of a three-inch tool cabinet drawer.
Figure 8:
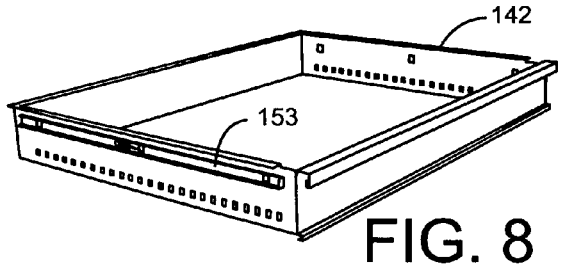
FIG. 8 is an isometric view of a five-inch tool cabinet drawer.
Figure 6:
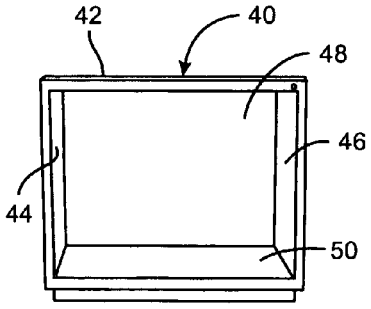
FIG. 6 is a front isometric view of a short tool cabinet shell without drawers.
Figure 9:
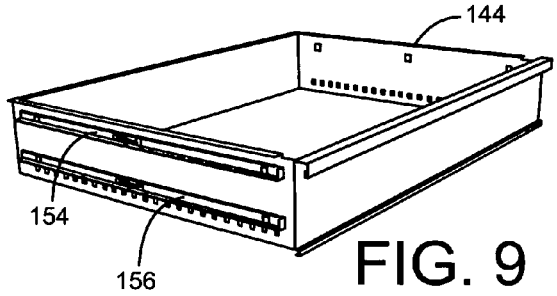
FIG. 9 is an isometric view of a seven-inch tool cabinet drawer.
Figure 10:
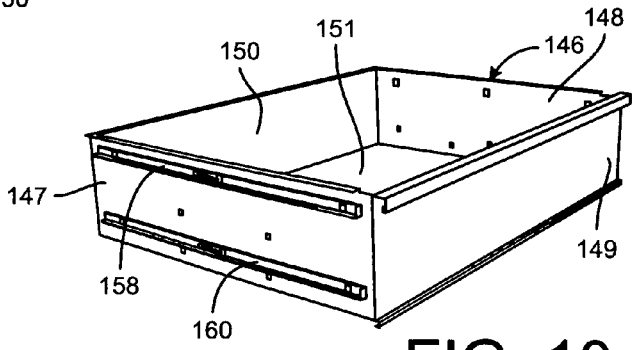
FIG. 10 is an isometric view of an eight-inch tool cabinet drawer.
Figure 13:
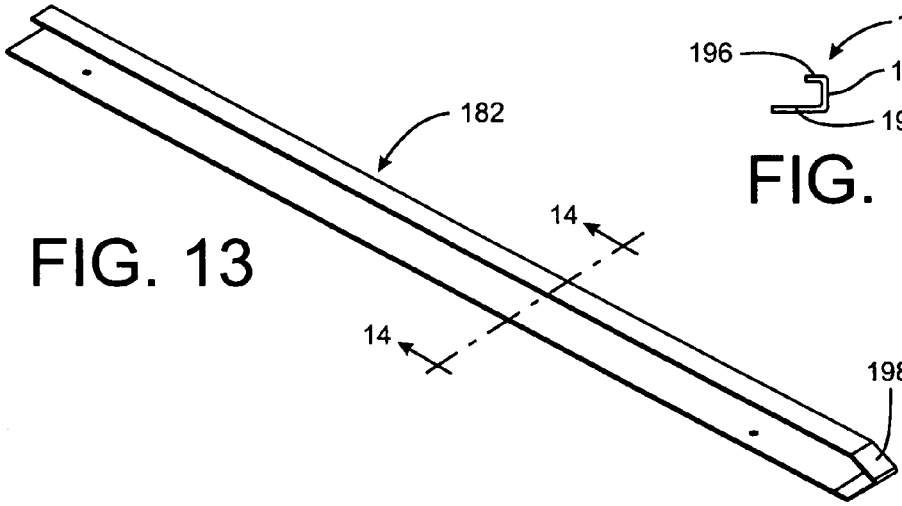
FIG. 13 is an isometric view of a drawer strike.
Figure 14:
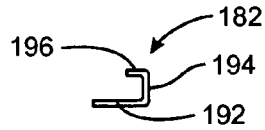
FIG. 14 is a section view of the drawer strike taken along line 14-14 of FIG. 13.

The tall cabinet 12 may be formed from a cabinet shell 14, FIG. 5, and preferably has a height of about forty-three inches, a width of about thirty-nine inches and a depth of about twenty-seven and a half inches. The tall cabinet shell 14, includes a top wall 16, two sidewalls 18, 20, a rear wall 22 and a bottom wall 24. In the alternative, the tall cabinet may have other dimensions, and both the tall and short cabinets may be formed from frameworks to which sidewalls, top and bottom walls and rear walls may be mounted. The cabinets 10, 12 may also include a handle 26, FIG. 1, and a set of wheels, such as the wheels 28, 30. The short cabinet 10 is formed from the cabinet shell 40, FIG. 6, and preferably has the same width and depth as the tall cabinet shell 14 but a height of about thirty-four inches. The short cabinet shell 40, has a top wall 42, two sidewalls 44, 46, a rear wall 48 and a bottom wall 50. In the alternative, the tall and short cabinets may have other dimensions provided that drawer sizes are adjusted accordingly, the cabinets may be built without wheels or handles, and like the tall cabinet, the short cabinet shell may be formed from a framework to which walls may be added.

Figure 3:
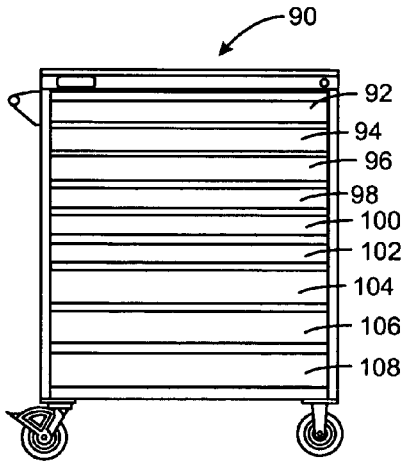
FIG. 3 is a reduced front elevation view of the tall tool cabinet shown in FIG. 2, but illustrating nine drawers of two different size configurations.
Figure 4:
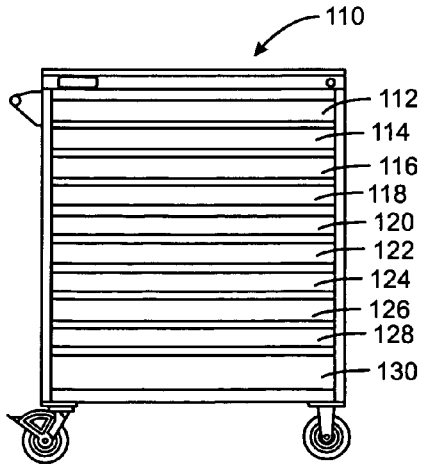
FIG. 4 is a front elevation view of the tall tool cabinet shown in FIGS. 2 and 3, but illustrating ten drawers of two different size configurations.

Each cabinet may be customized by having drawers chosen by a customer from a variety of drawer height configurations. By way of example, the short tool cabinet 10, FIG. 1, may have four drawers 60, 62, 64, 66 of equal height, such as seven inches, and the tall tool cabinet 12, FIG. 2, may be configured to have eight drawers 70, 72, 74, 76, 78, 80 82, 84, consisting of one eight-inch drawer 84, two, five-inch drawers 80, 82 and five, three-inch drawers 70, 72, 74, 76, 78. Shown in FIG. 3, is an alternative tall cabinet 90 with nine drawers 92, 94, 96, 98, 100, 102, 104, 106, 108, consisting of three, five-inch drawers 104, 106, 108 and six, three-inch drawers 92, 94, 96, 98, 100, 102. To exemplify the flexibility of the present cabinet/drawer structures, there is shown in FIG. 4, a variation tall cabinet 110 with ten drawers 112, 114, 116, 118, 120, 122, 124, 126, 128, 130, consisting of one, five-inch drawer 130 and nine, three-inch drawers 112, 114, 116, 118, 120, 122, 124, 126, 128. Other drawer configurations may be arranged, typically as a function of a customer's needs, as described in detail below.

Referring to FIGS. 7-10, four different drawer configurations are illustrated, and these may be mixed and matched with the standard tall and short cabinets. Each drawer may include two sidewalls, a front wall, a rear wall, and a bottom panel as illustrated in FIGS. 7-10. The four configurations include a three-inch drawer 140 illustrated in FIG. 7, a five-inch drawer 142 illustrated in FIG. 8, a seven-inch drawer 144 illustrated in FIG. 9, and an eight-inch drawer 146 illustrated in FIG. 10. By way of example, the drawer 146 includes two sidewalls 147, 148, a front wall 149, a rear wall 150 and a bottom panel 151. The three inch drawer 140 may have a load capacity of two hundred pounds, a width of about thirty-four and three quarters inches, a depth (front to back) of about twenty-five inches and a working height of about two and a quarter inches. The five-inch drawer 142 may have the same capacity, width and depth as the three-inch drawer 140, but have a working height of four inches. The seven-inch drawer 144 may have a four hundred pound capacity, the same width and depth as the three and five-inch drawers 140, 142 and a working height of five and three-quarters inches. The eight-inch drawer 146 may have the same capacity, width and depth as the seven-inch drawer 144 and a working height of seven and a half inches. The three and five-inch drawers 140, 142 include two drawer slides each, one slide on each side of each drawer, of which one drawer slide is shown, the drawer slide 152 illustrated in FIG. 7, and the drawer slide 153 illustrated in FIG. 8. The seven and eight inch drawers 144, 146 include four drawer slides each, two slides on each side of each drawer, of which two drawer slides are shown, the drawer slides 154, 156 illustrated in FIG. 9, and the drawer slides 158, 160 illustrated in FIG. 10. Each track slide may include separable elements, one element connected to the drawer and the other element connected to an inner panel in the cabinet shell where the elements are then attached to one another, or the elements may be permanently attached to one another.

To illustrate the wide choice of different drawer combinations available to a customer with different drawer height configurations that fit into the two standard sized cabinet shells 14, 40, reference is made to charts 170, 172 illustrated in FIGS. 11 and 12, respectively. The tall cabinet shell 14 may include twenty-nine different drawer combinations as indicated in a first column, ranging from five to ten drawers in different sizes. The short cabinet shell 40 may include seventeen drawer combinations, ranging from four to eight drawers in different sizes. A wide choice of drawer height configurations is available to a customer to enable storage of tools that the customer uses in its metal forming business. The wide choice may be built and assembled with standard structural elements and a minimum inventory so that customization of a tool cabinet to meet a customer's needs is efficient, fast and inexpensive. Nevertheless, each tool cabinet includes the major safety feature of allowing only one drawer to open at a time, and thereby preventing potentially life threatening accidents should a heavy tool cabinet tip over because two or more drawers were opened at the same time.

Figure 15:
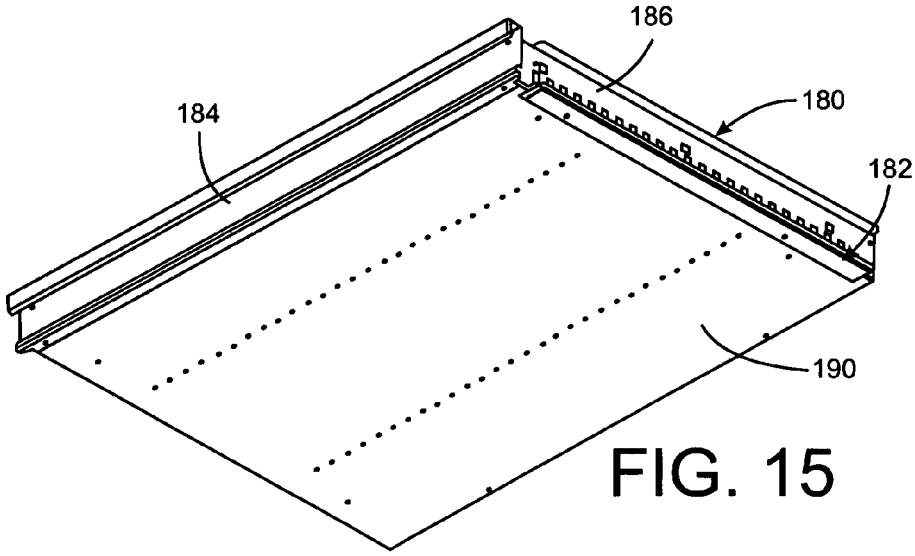
FIG. 15 is an upward looking isometric view of a drawer with a connected drawer strike.
Figure 16:
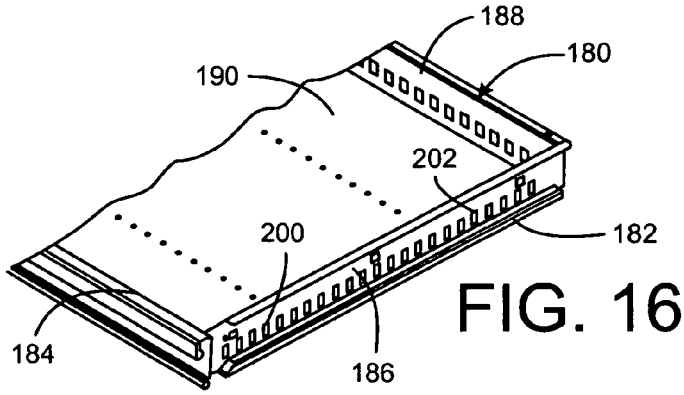
FIG. 16 is a downward looking isometric view of a portion of the drawer and the drawer strike shown in FIG. 15.
Figure 17:
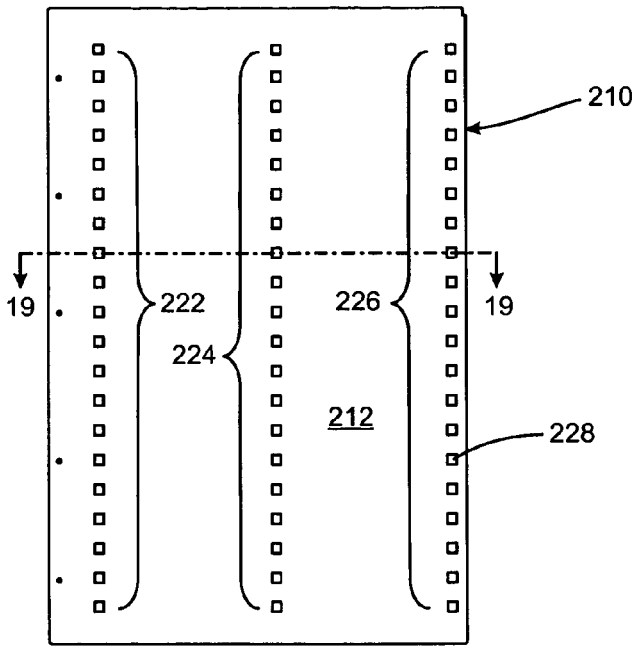
FIG. 17 is a front elevation view of an inner cabinet panel.

Each drawer, such as the drawer 180, FIGS. 15 and 16, is provided with a projection or strike 182, FIGS. 13-16, which may have a generally J-shaped channel configuration in cross section. A drawer 180 includes a front wall 184, two sidewalls of which only one sidewall 186 is illustrated, a rear wall 188 and a bottom panel 190. The strike or projection 182, FIGS. 13 and 14, may be elongated with a wide horizontal bottom wall 192, a vertical connecting wall 194 and a narrow horizontal top wall 196 that is generally parallel to the bottom wall 192. The strike 182 may also include a sloping nose 198 to contact and separate lock blocks when the drawer is opened, as described in detail below. The drawer strike may be made of any suitable material, such as steel, and may have the bottom wall 192 fastened to the drawer bottom panel 190 such that the strike 182 extends laterally from the drawer as shown in FIGS. 15 and 16. Drawer slide tracks have been removed in FIGS. 15 and 16 to enhance the view of the strike. A drawer slide track may easily be added using some of the openings in the drawer sidewall 186, such as the openings 200, 202. In the alternative, other convenient cross section shapes may be used for the strike.

A "universal" inner panel 210, FIGS. 17-20, may be mounted to the cabinet shells with the panel forming a support for the drawers and a safety lock system. The inner panel is universal because no matter the configuration of drawers, each tall cabinet shell receives the same tall inner panel (one on each side of the cabinet shell) and each short cabinet shell receives the same short inner panel, unlike prior tool cabinets where each drawer configuration required a different inner panel. Therefore, inventory of cabinet parts are reduced. The inner panel 210 includes a main surface 212, upper and lower flanges 214, 216 and side flanges 218, 220. The main surface 212 of the inner panel includes three columns of evenly spaced openings 222, 224, 226, such as the opening 228, for mounting cabinet slide tracks to the cabinet shell which will mate and operatively cooperate with the drawer slide tracks of the drawer configurations installed. There is also a column of fastener positions 230, FIG. 18, in the side flange 220 for receiving rivets to connect a block guide. The spacing of the openings in the three columns provides the flexibility to mount drawers of different sizes as outlined in the drawer charts 170, FIG. 11, and 172, FIG. 12. An identical second inner panel, not shown, may be mounted in the cabinet shell opposite the inner panel 210.

Figure 18:
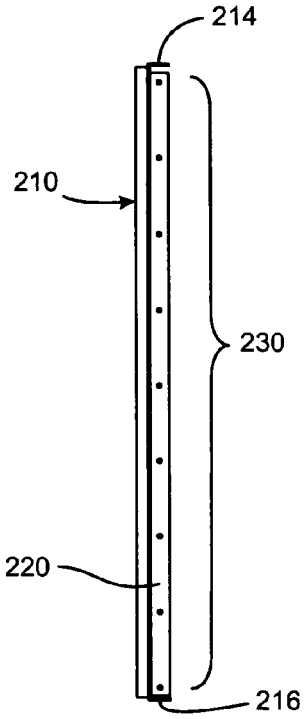
FIG. 18 is a side elevation view of the panel shown in FIG. 17.
Figure 19:
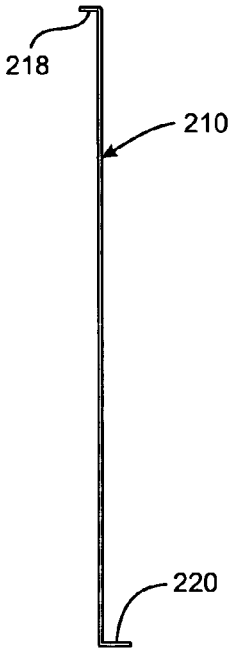
FIG. 19 is an enlarged section view taken along line 19-19 of FIG. 17 and rotated 90° clockwise.
Figure 20:
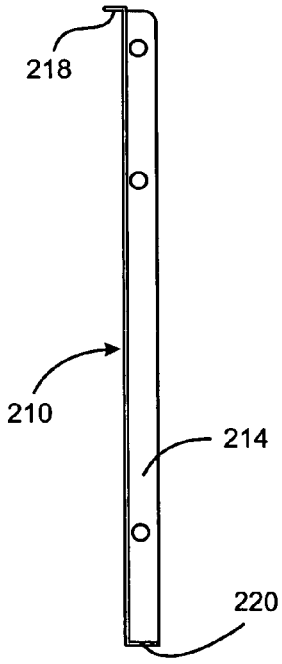
FIG. 20 is an enlarged top plan view of the panel shown in FIG. 17 and rotated 90° clockwise.
Figure 21:
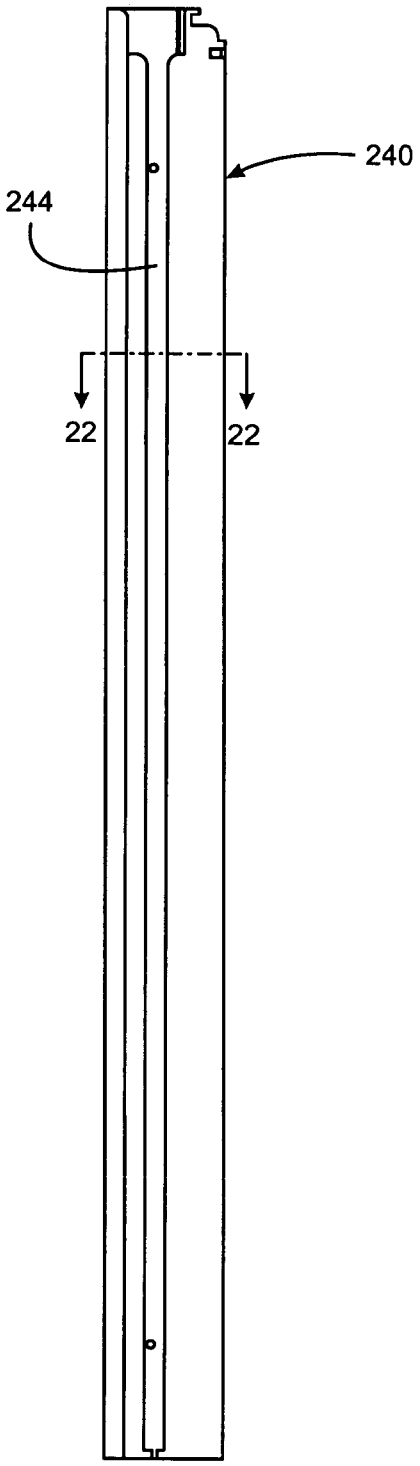
FIG. 21 is a front elevation view of a guide for stacking lock blocks.
Figure 22:
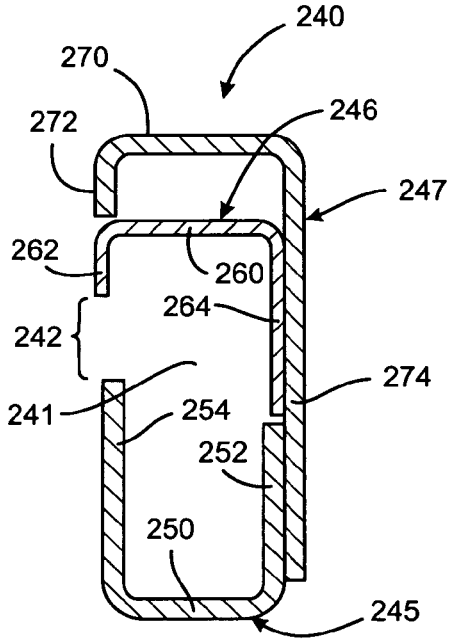
FIG. 22 is an enlarge section view take along line 22-22 of FIG. 21 and rotated 90° clockwise.

An important feature of the present invention is a vertically oriented, block guide 240 FIGS. 21 and 22, fastened to the side flange 220, FIG. 18, of the inner panel 210. The guide 240 is elongated and approximately the same length as the inner panel and is formed to have in cross section a generally C-shaped interior space 241 as shown in FIG. 22. The opening 242 of the C-shaped configuration forms an elongated and continuous slot 244. The guide 240 may be formed from three generally J-shaped steel members, a front member 245 and a back member 246 for forming the C-shaped space 241, and a mounting member 247 for connecting the front and back members 245, 246 to the inner panel 210. In cross section shown in FIG. 22, the front member 245 appears as a backward "J" having a base portion 250 and two wall portions, a narrow wall 252 and a slightly wider wall 254. The back member 246 appears as an upside down "J" in cross section in FIG. 22, with a base portion 260, a narrow wall portion 262 and a wider wall portion 264. The mounting member 247 also appears as an upside down "J" in cross section, although larger than the back member 246, with a base portion 270, a narrow wall portion 272 and a wider wall portion 274.

The narrow wall 252 of the front member 245 may be welded to the wider wall 274 of the mounting member 247 as may the wider wall 264 of the back member 246. The base 270 of the mounting member 247 may be attached to the side flange 220 of the inner panel 210 by rivets, welds or any other suitable means. It is noted that the gage or thickness of the front and mounting members 245, 247 is larger than the gage of the back member 246, twelve gage (about 0.108 inches) compared to fourteen gage (about 0.078 inches), and that the wider wall 254 of the front member 245 is misaligned or offset from the narrow wall 262 of the back member 246 and that the gap 242 exists between these two walls. In FIG. 21, the gap 242 appears as the continuous elongated slot 244 that extends substantially the length of the guide 240 to allow lock blocks to easily slide vertically in response to an opening drawer. It is noted that at the bottom portion of the guide, the slot may be narrowed or terminated. As another advantage, attachment of the guide 240 to the inner panel 210 has the benefit of strengthening both the inner panel and the cabinet.

In the alternative, other cross section shapes may be used for the front, back and mounting members 245, 246, 247. For example, the mounting member 247 may be L-shaped, the front member 245 may be U-shaped as may the back member 246. The main concern is that the walls 254, 262 bordering the gap 278 be offset and of unequal thicknesses, although if quick proper alignment of the blocks is not a concern, the walls 254, 262 may be aligned and/or of equal thickness.

Figure 23:
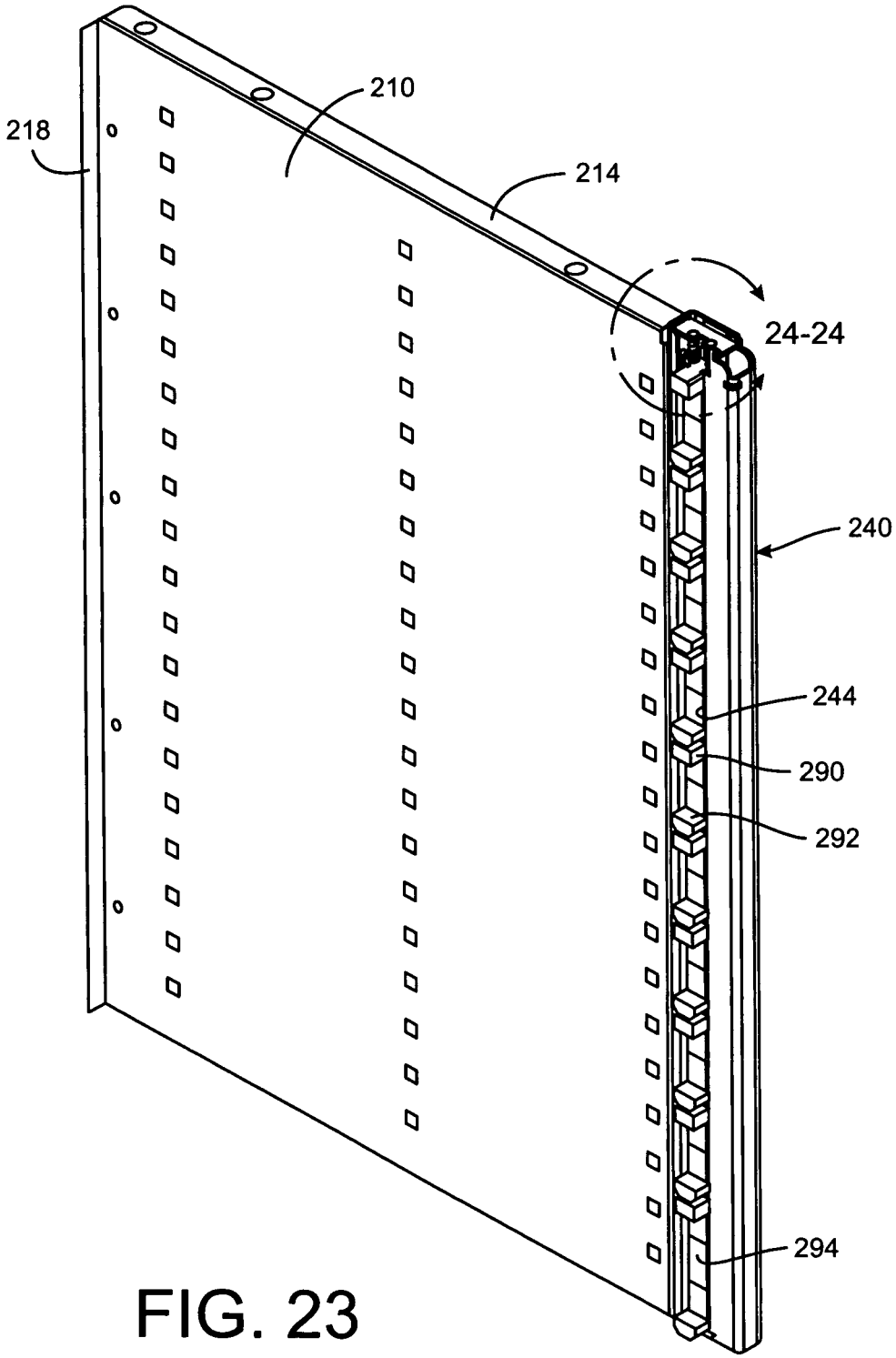
FIG. 23 is an enlarged isometric view of the panel shown in FIG. 17 with the guide shown in FIG. 21 attached, and with the guide stacked with lock blocks.
Figure 24:
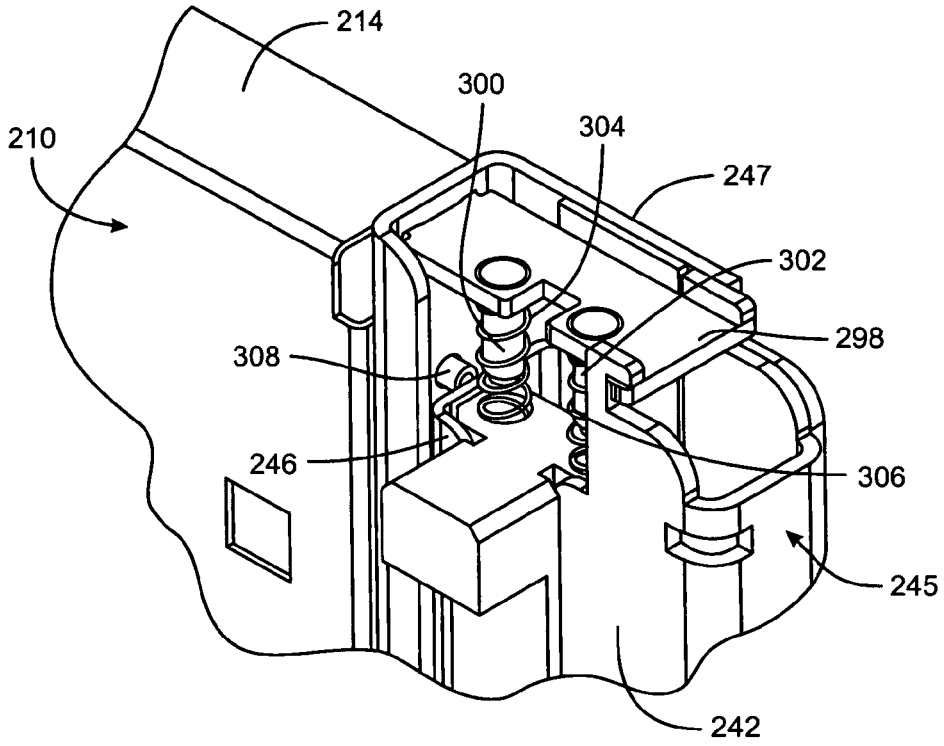
FIG. 24 is an enlarged view taken within circle 24-24 of FIG. 23.

Illustrated in FIGS. 23 and 24, is the inner panel 210 to which is attached the guide 240, and the guide is stacked with locking blocks, such as the blocks 290, 292, 294. As can be seen, protrusions from the blocks extend through the elongated slot 244 of the guide 240. Mounted to the upper portion of the guide is a bracket 298 to which is attached two pins 300, 302 with each pin being surrounded by a spring 304, 306. A rivet 308 is also illustrated connecting the mounting member 247 to the inner panel 210. The blocks are able to move upward a predetermined distance, the height of a strike 182 when a drawer is opened, and are biased downward by the springs 304, 306 once the drawer is closed. The movement of the blocks and the lack of space for further movement of the blocks prevent other drawers from opening.

To work with the guide 240 the three lock blocks have somewhat different structures and manners of use. The three lock blocks include a first or upper block 290, a second or lower block 292 and a third or spacer block 294. The use of the blocks allows the standardized cabinet shells 14, 40 to accept drawers chosen from the various size configurations illustrated in FIGS. 7-10 (and configured according to the charts 170, FIG. 11, and 172, FIG. 12), and yet, still maintain the important one-drawer-open-at-a-time safety feature. The safety lock system allows a tool cabinet customer to customize drawer sizes to be installed in a cabinet shell so as to be consistent with the various tools the customer will store in the completed cabinet. The drawer configurations run in size from three to eight inches in height. The lock blocks 290, 292, 294 may be made of any suitable material, such as being molded of a suitable synthetic resin, as exemplified by ABS plastic, and are sized to slide in the guide 240, one block on top of another block as shown in FIGS. 23 and 31-35. The novel arrangement of the guide and the use of the three sets of blocks allow an efficient and low cost assembly process in that all cabinet configurations include the same inner panels (within one of the two standard size cabinets), the same guides and the same blocks. Only the block sequence in the block guide need be altered depending upon the drawer configuration. Therefore, assembly is very streamlined and easy and also cost effective.

Figure 25:
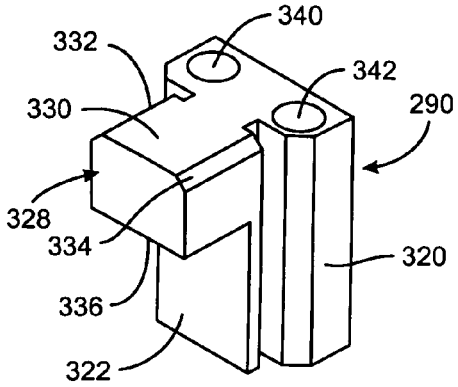
FIG. 25 is an isometric view of a lock block with an upper protrusion.
Figure 26:
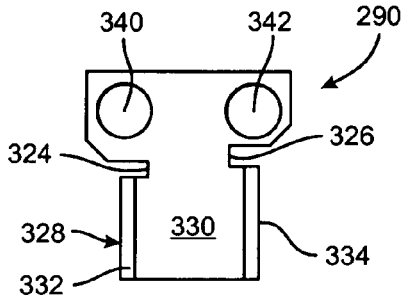
FIG. 26 is a top plan view of the block shown in FIG. 25.

The upper block 290, FIGS. 25 and 26, includes a rear portion 320 and a front portion 322 separated by two offset and different sized grooves, a narrow groove 324 and a wide groove 326. Projecting from an upper region of the front portion 322 is a protrusion 328. The rear portion is sized to fit into the guide space 241 such that the wide groove 326 receives the wide wall 254 of the guide front member 245 and the narrow groove 324 of the upper block receives the narrow wall 262 of the guide back member 246. Having two grooves of different sizes prevent the blocks from being mistakenly placed in an upside down or reversed position. The protrusion 328 includes an upper horizontal surface 330 bordered by two slanted surfaces 332, 334 that are formed about 45° from a horizontal. The protrusion 328 also includes a lower horizontal surface 336. The upper locking block 290 also includes two holes 340, 342 for receiving the pins 300, 302, FIG. 24, when the blocks above an open drawer are moved upwards by a strike of that open drawer.

Figure 27:
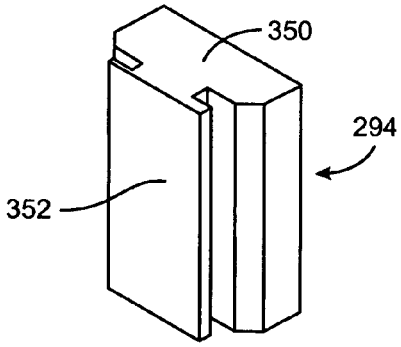
FIG. 27 is an isometric view of a spacer block.
Figure 28:
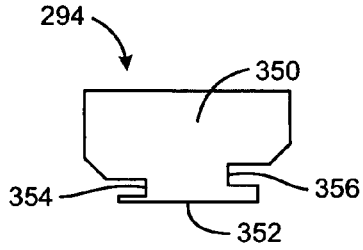
FIG. 28 is a top plan of the spacer block shown in FIG. 27.

The spacer block 294, FIGS. 27 and 28, also includes a rear portion 350 and a front portion 352 separated by two grooves of different sizes, a narrow groove 354 and a wide groove 356, identical to the grooves 324, 326, respectively, of the upper block 290. The front portion 352 is generally flat and does not include a protrusion. The spacer block 294 functions as a spacer when needed between the upper block 290 and the lower block 292, such as shown in the lower portion of FIG. 23.

Figure 29:
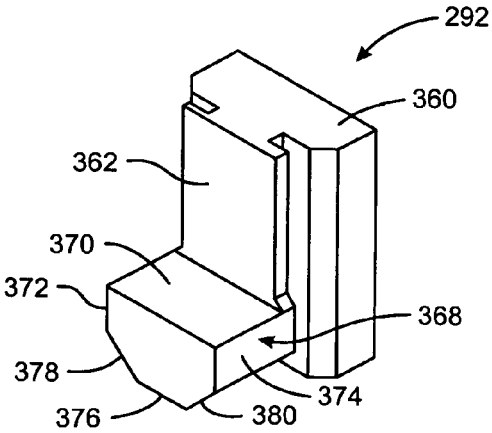
FIG. 29 is an isometric view of a lock block with a lower protrusion.
Figure 30:
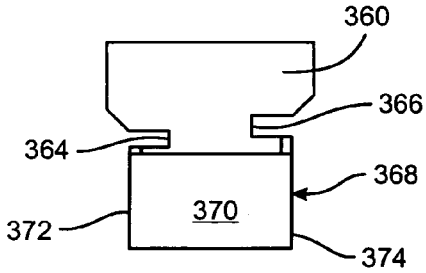
FIG. 30 is a top plan of the block shown in FIG. 29.

The lower block 292, FIGS. 29 and 30, also includes a rear portion 360 and a front portion 362 separated by two different sized grooves, a narrow groove 364 and a wide groove 366, identical to the grooves 324, 326, respectively, of the upper block 290 and the grooves 354, 356, respectively, of the spacer block 294. Projecting from the front portion 362 of the lower block 292 is a lower protrusion 368, similar in shape to the protrusion 328 of the upper block 290 but inverted. The lower protrusion 368 includes an upper horizontal surface 370, two side surfaces 372, 374, and a lower horizontal surface 376 flanked by two slanted surfaces 378, 380 that are formed about 45° from a horizontal.

Figure 31:
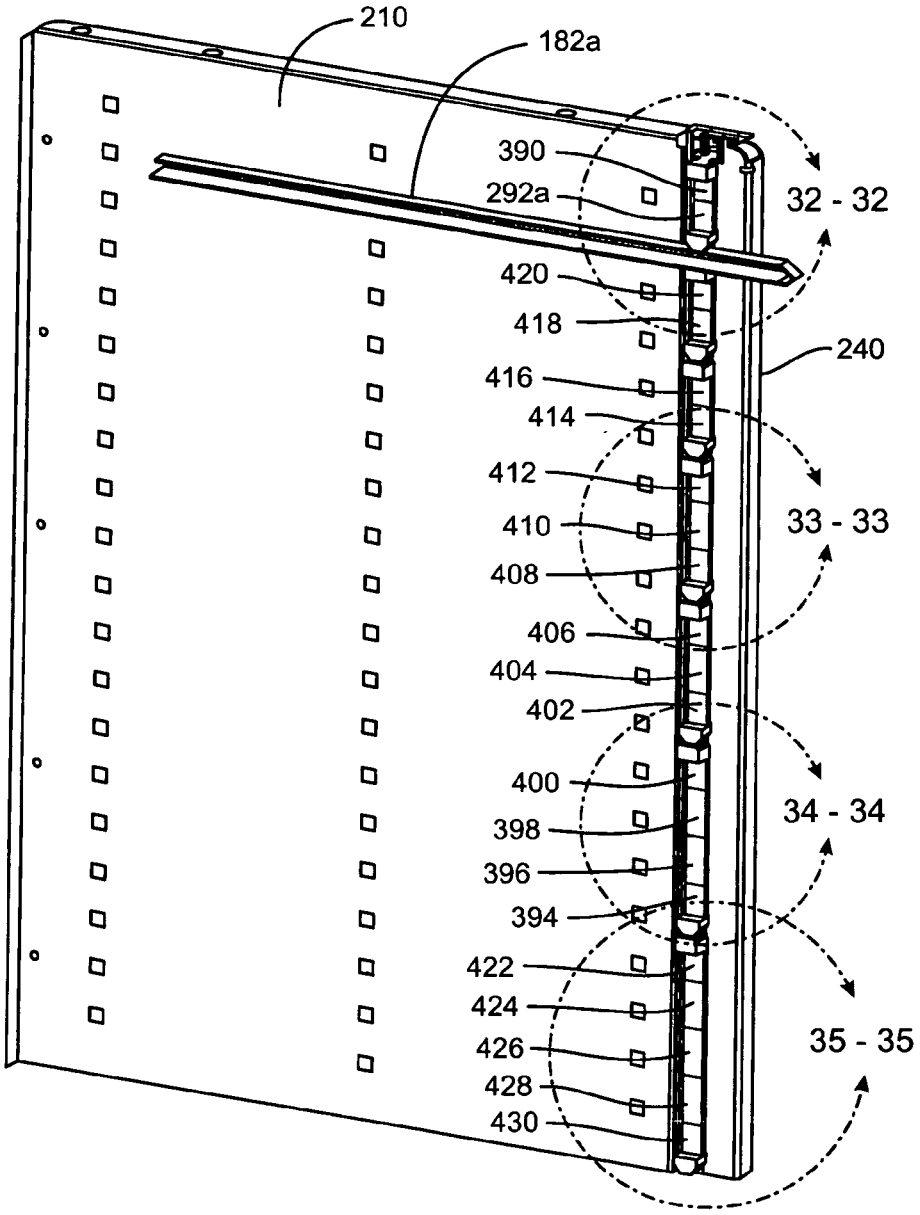
FIG. 31 is an isometric view of the panel, the guide and blocks shown in FIG. 23, and a drawer strike of an open top drawer (not shown) displacing the upper two blocks.
Figure 32:
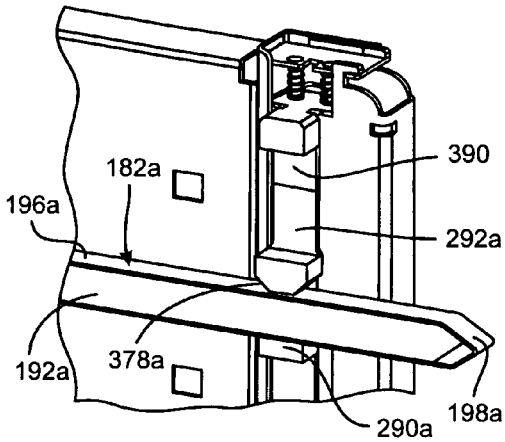
FIG. 32 is an enlarged view taken within circle 32-32 of FIG. 31.
Figure 33:
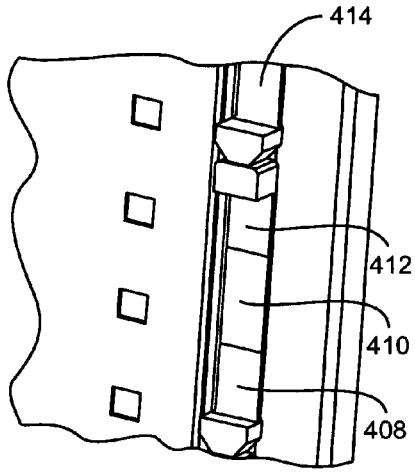
FIG. 33 is an enlarged view taken within circle 33-33 of FIG. 31, illustrating an alignment of lock blocks for a five-inch drawer.
Figure 34:
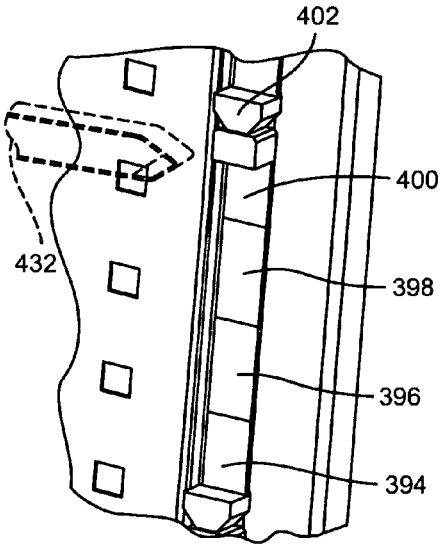
FIG. 34 is an enlarged view taken within circle 34-34 of FIG. 31, illustrating an alignment of lock blocks for a seven-inch drawer.
Figure 35:
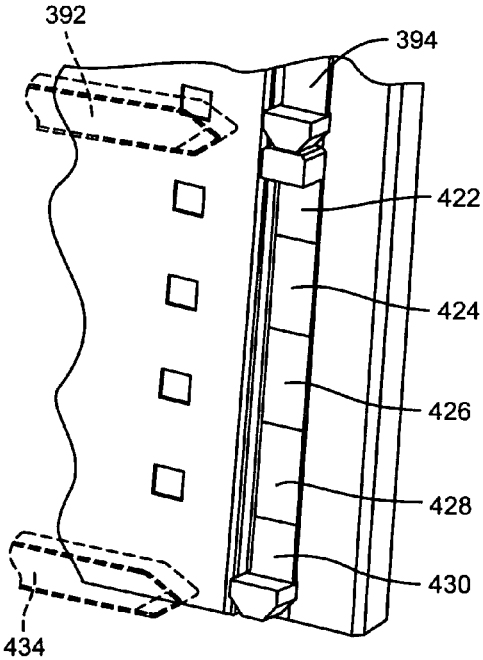
FIG. 35 is an enlarged view taken within circle 35-35 of FIG. 31, illustrating an alignment of lock blocks for an eight-inch drawer.

As shown in FIGS. 31 and 32, a slanted surface **378*a* of a lower block 292*a* as well as a slant surface 332*a* (hidden by the strike) of an upper block 290*a* is engaged by a nose 198*a* of a strike 182*a* when the drawer to which the strike is attached is opened. It should be noted that strikes from each drawer will engage a corresponding lower and upper block pair as shown in FIGS. 31, 32, 34 and 35, provided that the drawer is the first drawer of the cabinet to be opened. Upon opening, the nose of the strike will displace the lower block of the pair upwards, and the short upper wall 196*a* of the strike 182*a* will support that lower block 292*a* and all of the blocks above the displaced block, such as the upper block 390. The locking feature occurs because once a drawer is opened, all of the blocks above the displaced block become misaligned with strikes of drawers above the open drawer, and all of the blocks below the displaced block no longer have room to move upward in the guide because they are prevented by the wide bottom wall 192*a* of the strike and they are unable to move downward because there is no room to do so. Therefore, strikes of drawers above and below the open drawer may no longer displace any block and cannot be opened. For example referring to FIG. 35, if a drawer just above the bottom drawer is opened, the strike 392 of that drawer will displace the block 394 upwards as will all of the blocks above the block 394, such as the blocks 396, 398, 400, 402, 404, 406, 408, 410, 412, 414, 416, 418, 420, 292*a*, 390, FIG. 31, causing a misalignment of blocks with all of the strikes and attached drawers above the opened drawer (see the strike 432, FIG. 32, drawn in phantom lines), and because the blocks below the opened drawer will be prevented from moving, such as the blocks 422, 424, 426, 428, 430, FIG. 35, the bottom most drawer will be prevented from opening because the strike 434, also drawn in phantom lines, of the bottom-most drawer will simply abut the bottom block 430** without being able to displace it.

It has been found that all of the blocks may be about 1.75 inches in height, about 1.188 inches wide and about 1.235 inches in depth including a protrusion, or about 0.67 inches in depth when the protrusion is absent. The wide groove may be about 0.125 inches in width and the narrow groove may be about 0.095 inches in width. The blocks are stacked in the guide 240 as shown in FIGS. 31-35. The number and placement of each block in the guide is a function of the number and size of the drawers to be placed in the cabinet shell. For example, the three-inch drawer 140, FIG. 7, requires only one upper block 390 and one lower block 292*a* as illustrated in FIG. 32. The five-inch drawer 142, FIG. 8, requires one upper block 412, FIG. 33, one lower block 408 and a spacer block 410. The seven-inch drawer 144, FIG. 9, requires one upper block 400, FIG. 34, one lower block 394 and two spacer blocks 396, 398. The eight-inch drawer 146, FIG. 10, requires one upper block 422, FIG. 35, one lower block 430 and three spacer blocks 424, 426, 428. In the alternative, other drawer dimensions may be used provided that dimensions for the cabinet and blocks are altered to be consistent. The actual dimensions set forth above are for a preferred system.

The tool cabinet flexibility advantage is achieved by using the three block system described above, and allows a cabinet buyer to tailor the cabinet to the size of tools to be stored. The three-block system has the added advantages to a cabinet manufacturer of common parts and lower inventory, and simple and efficient assembly, major competitive benefits. It is also noted that the inventive system allows a cabinet made in one configuration to be easily altered by simply removing the bracket 298 and rearranging the way the blocks are stacked. Thus, should a customer's requirements change in the future, its tool cabinet may be easily reconfigured accordingly.

It is noted that throughout this disclosure, words such as "upper," "lower," "front," and "rear," as well as like terms, refer to portions of the lock blocks or cabinets as they are viewed in the drawings relative to other portions, or in relationship to the positions of the elements as they will typically be positioned in the finished cabinet.

In the alternative, as mentioned, additional cabinet shells of different dimensions may be used, or the two shells described above may be altered in size. Drawer sizes may be changed, as may the sizes of the blocks and the guide. The shape of the protrusions may also be changed, if desired.

In operation of the inventive system, a customer chooses the cabinet shell size desired, and from the charts shown in FIGS. 11 and 12, the drawer configuration desired. Thereafter, the manufacturer forms a cabinet shell, the drawers, a block guide and the inner panel. The block guide is attached to the inner panel and the inner panel/block guide is attached to the cabinet shell. Drawer and cabinet slides are attached to the drawers and the inner panel and the blocks are stacked in the guide in accordance with the drawer configuration chosen. The drawers complete the tool cabinet. Assembly is quick, simple and efficient.

Figure 36:
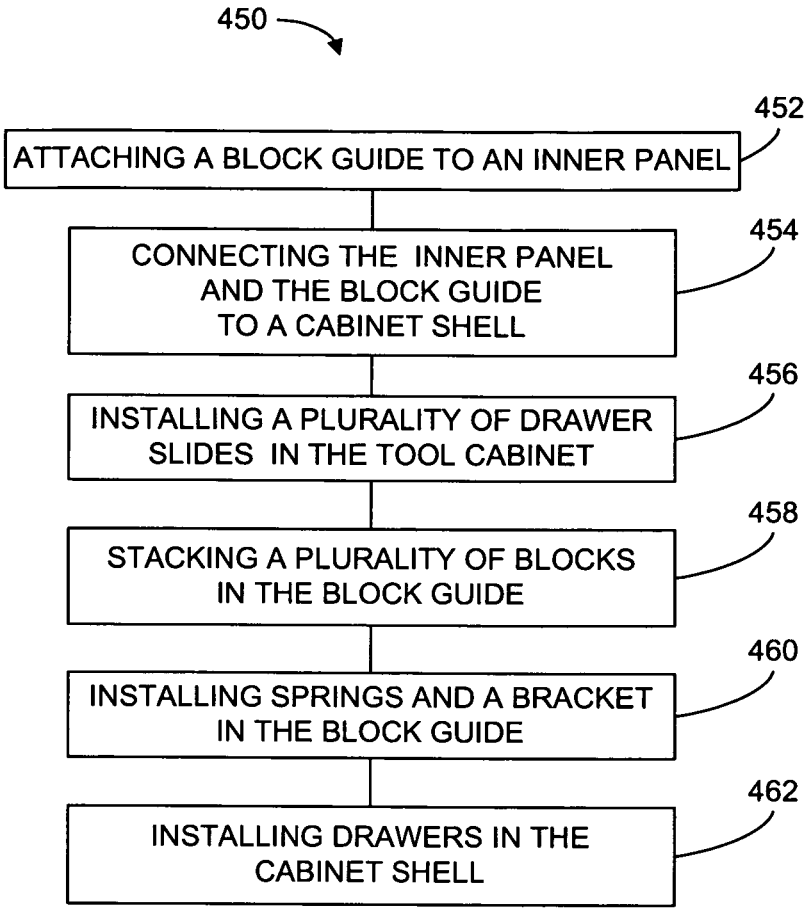
FIG. 36 is a flow diagram for a method of assembling a tool cabinet like that illustrated in FIG. 2.

The present invention also includes a method 450, FIG. 36, for assembling a tool cabinet having a safety lock system including the steps of attaching a block guide to an inner panel 452, the block guide having an elongated slot, such as the guide 240 and slot 244, and the panel 210, connecting the inner panel and the block guide to a cabinet shell 454, installing a plurality of drawer slides in the tool cabinet 456, stacking a plurality of blocks in the block guide 458 as a function of the drawers to be installed, installing springs and a bracket in the block guide 460, such as the springs 304, 306 and the bracket 298, and installing drawers in the cabinet shell 462. The method may also include the steps of forming each block to have opposing grooves, the grooves being misaligned and of unequal widths, forming the block guide to have walls bordering the elongated slot that are misaligned and of unequal thicknesses, and forming the block guide from two J-shaped channel members.

The tool cabinet safety lock system enables the customization of a tool cabinet by allowing a customer to choose drawer configurations from various drawer sizes while maintaining the safety feature of allowing only one-drawer-at-a-time to be opened. The system has a robust, but relatively simple structure, which may be produced and assembled efficiently and at a reasonable cost.

From the foregoing, it can be seen that there has been provided features for an improved tool cabinet with a safety lock system and a disclosure for the method for assembling the tool cabinet. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent patent claims when viewed in their proper perspective based on the prior art.

What is claimed is:

1. A safety lock system for a tool cabinet comprising:

a tool cabinet having a plurality of drawers, each drawer having a projection;

a block guide connected to the tool cabinet, the block guide forming a space for a plurality of lock blocks and having a continuous elongated slot extending substantially the length of the block guide wherein the guide slot is bordered by opposing walls of unequal thicknesses; and a plurality of lock blocks slideably received in the block guide space wherein selected portions of the lock blocks extend through the elongated slot for being selectively engaged by drawer projections when drawers are opened and wherein each lock block of the plurality of lock blocks has grooves of unequal widths to receive the opposing walls of the guide slot.

2. The safety lock system as claimed in claim 1, wherein:

the guide slot is bordered by misaligned opposing walls; and each lock block of the plurality of lock blocks has misaligned grooves.

3. The safety lock system as claimed in claim 1, wherein:

the block guide is formed of two J-shaped channel members having unequal thicknesses; and including a third J-shaped channel member for mounting the block guide to the tool cabinet.

4. A safety lock system for a tool cabinet comprising:

a tool cabinet having a plurality of drawers, each drawer having a projection;

a block guide connected to the tool cabinet, the block guide forming a space for a plurality of lock blocks and having a continuous elongated slot extending substantially the length of the block guide wherein; and a plurality of lock blocks slideably received in the block guide space wherein selected portions of the locking blocks extend through the elongated slot for being selectively engaged by drawer projections when drawers are opened, the plurality of lock blocks including three different configurations, a first configuration wherein lock blocks have an upper protrusion for extending through the elongated slot of the block guide, a second configuration wherein lock blocks have a lower protrusion for extending through the elongated slot of the block guide and wherein selected protrusions of first and second lock blocks are paired to correspond to drawer projections, the paired protrusions being located adjacent one another to prevent opening of drawers when a drawer of the plurality of drawers is already open, and a third configuration wherein lock blocks have no protrusion, and the number of lock blocks having the third configuration are selectively located between lock blocks of the first and second configurations as a function of drawer height.

5. The safety lock system as claimed in claim 4, wherein:

the plurality of lock blocks include combinations of lock blocks having the first and second configurations, lock blocks having the first and second configurations separated by one lock block having the third configuration, lock blocks having the first and second configurations separated by two lock blocks having the third configuration, and lock blocks having the first and second configurations separated by three lock blocks having the third configuration.

6. The safety lock system as claimed in claim 5, wherein:

the guide slot is bordered by opposing misaligned walls of unequal thicknesses; and each lock block of the plurality of lock blocks have misaligned grooves of unequal widths.

7. The safety lock system as claimed in claim 6, wherein:

the guide space is generally C-shaped.

8. The safety lock system as claimed in claim 4, wherein:

the guide slot is bordered by opposing walls of unequal thicknesses; and each lock block of the plurality of lock blocks has grooves of unequal widths.

9. The safety lock system as claimed in claim 4, wherein:

the guide slot is bordered by misaligned opposing walls; and each lock block of the plurality of lock blocks has misaligned grooves.

10. A safety lock system for a tool cabinet comprising:

a cabinet;

a plurality of drawers mounted to the cabinet, the plurality of drawers being chosen from various drawer height configurations;

a projecting strike connected to each drawer;

a panel connected to the cabinet having a column of spaced openings, each of the openings available to receive a cabinet slide track to mate with a drawer slide track;

a block guide connected to the panel, the block guide having a single, vertically oriented, elongated slot bordered by opposing guide walls;

a plurality of first blocks selectively stacked in the block guide, each first block of the plurality of first blocks having a rear portion, a front portion, two grooves and an upper protrusion extending from the front portion, the two grooves of each of the first blocks enabling the first block to be mounted to the guide walls;

a plurality of second blocks selectively stacked in the guide, each second block of the plurality of second blocks having a rear portion, a front portion, two grooves and a lower protrusion extending from the front portion, the two grooves of each of the second block enabling the second block to be mounted to the guide walls; and a plurality of third blocks selectively stacked in the block guide between first and second blocks, each third block of the plurality of third blocks having a rear portion, a front portion and two grooves, the two grooves of each of the third block enabling the third block to be mounted to the guide walls wherein the number of third blocks located between first and second blocks is a function of a corresponding drawer configuration.

11. The safety lock system of claim 10, wherein:

the opposing guide walls are misaligned and of unequal thicknesses.

12. The safety lock system of claim 11, wherein:

the two grooves of each block of the plurality of first, second and third blocks are of unequal widths and misaligned for being receivable by the opposing guide walls.

13. The safety lock system of claim 12, wherein:

the drawer height configurations are labeled three inches, five inches, seven inches and eight inches and the number of third blocks located between first and second blocks for an eight inch drawer is three, the number of third blocks located between first and second blocks for a seven inch drawer is two, the number of third blocks located between first and second blocks for a five inch drawer is one, and no third block is located between first and second blocks for a three inch drawer.

14. A method for assembling a tool cabinet having a safety lock system comprising the steps of:

connecting a block guide to a cabinet shell, the block guide having an elongated slot;

stacking a plurality of lock blocks in the block guide, the plurality of lock blocks includes lock blocks of three different configurations, lock blocks of a first configuration wherein each first configuration lock block includes an upper protrusion for extending through the elongated slot of the block guide, lock blocks of a second configuration wherein each second configuration lock block includes a lower protrusion for extending through the elongated slot of the block guide, and lock blocks of a third configuration selectively located between the lock blocks of the first and second configurations; and installing biasing structure in the block guide to bear against the plurality of lock blocks.

15. The method for assembling a tool cabinet having a safety lock system as claimed in claim 14, including the step of:

forming each lock block of the plurality of lock blocks to have opposing grooves, the grooves being misaligned and of unequal widths.

16. The method for assembling a tool cabinet having a safety lock system as claimed in claim 15, including the step of:

forming the block guide to have walls bordering the elongated slot that are misaligned and of unequal thicknesses configured to receive the stack of lock blocks.

17. The method for assembling a tool cabinet having a safety lock system as claimed in claim 16, including the step of:

forming the block guide from two J-shaped channel members.

18. A safety lock system for a tool cabinet comprising:

a cabinet;

a plurality of drawers mounted to the cabinet, the plurality of drawers being chosen from drawers having various height configurations;

a projecting strike connected to each drawer of the plurality of drawers;

a block guide connected to the cabinet, the block guide having a single, vertically oriented, elongated slot bordered by opposing guide walls;

a plurality of lock blocks of a first configuration selectively stacked in the block guide, each first configuration lock block including an upper protrusion;

a plurality of lock blocks of a second configuration selectively stacked in the block guide, each second configuration lock block including a lower protrusion; and a plurality of lock blocks of a third configuration selectively stacked in the block guide between first and second configuration lock blocks.

* * * * *